US005912604A

United States Patent [19]

Harvey et al.

[11] Patent Number: 5,912,604

[45] Date of Patent: Jun. 15, 1999

[54] MOLDED POLE AUTOMATIC CIRCUIT RECLOSER WITH BISTABLE ELECTROMAGNETIC ACTUATOR

[75] Inventors: Ian James Harvey, Bloomington, Ind.; Aftab H. Khan; Robert A. Smith, both of Cary, N.C.; James E. Smith, Tarsboro, N.C.

[73] Assignee: ABB Power T&D Company, Inc., Raleigh, N.C.

[21] Appl. No.: 08/794,491

[22] Filed: Feb. 4, 1997

[51] Int. Cl.[6] ..... H01H 75/00; H01H 33/66

[52] U.S. Cl. ..... 335/9; 335/177; 335/234; 335/251; 335/255; 218/138

[58] Field of Search ..... 335/9, 177–179, 335/234, 236, 229, 251, 255; 218/138, 140

[56] References Cited

U.S. PATENT DOCUMENTS

| | | | |
|---|---|---|---|
| 3,812,314 | 5/1974 | Nonken | 200/144 B |
| 3,883,709 | 5/1975 | Cole | 200/144 B |
| 4,072,918 | 2/1978 | Read, Jr. | 335/236 |
| 4,267,402 | 5/1981 | Reighter | 174/137 R |
| 4,625,189 | 11/1986 | Lazar et al. | 335/10 |
| 4,683,452 | 7/1987 | Henley | 335/234 |
| 4,823,022 | 4/1989 | Lindsey | 307/149 |
| 4,827,370 | 5/1989 | St-Jean et al. | 361/127 |
| 4,859,975 | 8/1989 | Uetsuhara | 335/230 |
| 5,103,364 | 4/1992 | Kamp | 361/72 |
| 5,140,210 | 8/1992 | Shirakawa | 310/156 |
| 5,175,403 | 12/1992 | Hamm et al | 200/144 B |
| 5,440,183 | 8/1995 | Denne | 310/12 |
| 5,452,172 | 9/1995 | Lane et al. | 361/71 |
| 5,521,567 | 5/1996 | Devonald, III et al. | 335/132 |
| 5,663,712 | 9/1997 | Kamp | 340/644 |

FOREIGN PATENT DOCUMENTS

| | | |
|---|---|---|
| 0 580 285 A2 | 1/1994 | European Pat. Off. . |
| 2 289 374 | 11/1995 | United Kingdom . |
| WO 94/25973 | 11/1994 | WIPO . |

OTHER PUBLICATIONS

Gec Alsthom T&D Distribution Switchgear, Ltd., "OXR Pole Mounted Auto–recloser Up to 15.5kV," Ref. LB421–11 Edition C, Sep. 15, 1995, 8 pages.

*Primary Examiner*—Renee S. Luebke
*Assistant Examiner*—Tuyen T. Nguyen
*Attorney, Agent, or Firm*—Woodcock Washburn Kurtz Mackiewicz & Norris LLP

[57] ABSTRACT

An electromagnetic actuator and an automatic recloser incorporating such actuator are disclosed. The actuator is shown to include a housing, a permanent magnet member, a coil, an armature, mounted to move axially within the housing between first and second positions, and a non-magnetic spacer. The armature, when in the second position, is spaced a distance from the housing by the spacer. The spacer is mounted to stop movement of the armature in the second position. In the preferred embodiment, the permanent magnet member includes a core and a number of magnet segments attached thereto. It is especially preferred for each of the permanent magnet segments to be arcuate shaped and that each segment be polarized substantially radially or in a direction parallel to the center radius of each segment. In a preferred embodiment, the housing is formed from a material having a high permeability and the spacer is formed from material having a relative permeability close to one or from a substantially non-magnetic material, such as acetal resin.

The circuit recloser is shown to include the bistable magnetic actuator, a contact switch, a connecting member, connected between the actuator the contact switch and a spring, connected to bias the connecting member in relation to the contact switch. When the actuator is in its second position the end of the connecting member is spaced from the end of the contact switch, i.e., over travel is present. An indicator is provided for indicating whether the contact switch is open or closed.

23 Claims, 9 Drawing Sheets

MOLDED POLE AUTOMATIC CIRCUIT RECLOSER WITH BISTABLE ELECTROMAGNETIC ACTUATOR

FIELD OF THE INVENTION

The present invention relates generally to the field of automatic reclosers for high voltage AC distribution systems, and more particularly, to automatic reclosers assembly having bi-stable magnetic actuators for use therein.

BACKGROUND OF THE INVENTION

Automatic recloser devices are used in electrical distribution systems to protect high voltage power lines. Such devices are usually mounted to the poles or towers which suspend power lines above the ground. However, use with below ground systems is also known. The recloser device is used to minimize power distribution interruptions caused by transients or faults.

Typically, during a system disturbance, large increases in current, i.e., faults, will occur. Sensing a current increase, the recloser will open thereby cutting off current flow in order to protect distribution system components and other equipment connected to the distribution system. Since many fault conditions are temporary, the recloser is designed to close after a short period of time, thereby establishing normal current flow. For example, during a thunderstorm, if lightning were to strike the distribution system, the power to one's home may be disrupted for a few seconds causing lights and appliances to turn OFF (recloser opening), then ON (recloser closing). Once the recloser closes, if it senses the continued presence of increased current, it will again open. Such cycling between open and closed may occur three times before the recloser remains open.

A vacuum interrupter or vacuum switch is employed in many high voltage applications to perform the actual interrupting, i.e., opening and closing, function. Vacuum interrupters are used in reclosers, circuit breakers, intelligent switches for automated power distribution, and indoor switchgear. A typical vacuum interrupter comprises a pair of large-surface electrical contacts arranged in an axial configuration and enclosed within an evacuated metal-ceramic housing. One of the contacts is stationary, while the other moves in an axial direction to open and close the contacts.

In many reclosers, a number of vacuum interrupters are housed in either a single insulated enclosure or separate insulating enclosures along with related circuit components. For example, in three phase power distribution systems, separate interrupters are provided for each phase. An example of an automatic recloser for three phase use is disclosed in European Patent Application No. 580,285 A2 filed Jun. 14, 1993, entitled Auto-reclosers.

Enclosures can be filled with an insulating oil or gas (e.g. $SF_6$) having a high dielectric strength to provide electrical insulation between the vacuum interrupters and other components. Immersing the interrupters and associated sensing devices in an insulating oil or gas allows the individual assemblies to be mounted in closer proximity, thus reducing the overall size and cost of the equipment.

The electrical utility industry has been exploring the use of polymer concrete and similar dielectric materials as a replacement for porcelain in a wide variety of insulating applications. Polymer concretes are composite materials consisting of inorganic aggregates, such as silica, bonded together with a low viscosity organic resin. The most widely known polymer concrete formulations have been trademarked by the Electric Power Research Institute under the trade name Polysil. Polymer concretes are mechanically strong and have excellent electrical properties, including a Dielectric Strength in the range of 400 V/mil. Additionally, polymer concretes can be easily molded or cast into complex shapes. Epoxy-concrete is a similar solid dielectric material wherein epoxy is used to bond the silica aggregates. Various epoxy resins which do not contain silica aggregates, such as cycloaliphatic epoxy resin, also provide similar properties.

Nonken, U.S. Pat. No. 3,812,314, discloses an interrupter assembly for use in underground electric power distribution systems that comprises a vacuum interrupter switch embedded in a bushing formed of electrically insulated epoxy resin. Reighter, U.S. Pat. No. 4,267,402, discloses an insulator formed of polymer concrete that has mounting threads molded directly into the polymer concrete. St-Jean et al., U.S. Pat. No. 4,827,370 discloses a cylindrical enclosure formed of epoxy-concrete or polymeric concrete for housing a surge arrester. Lindsey, U.S. Pat. No. 4,823,022, discloses a power line insulator formed of Polysil. PCT Application No. PCT/US94/04835, filed Apr. 28, 1994 and entitled Integrated Electrical System discloses a vacuum interrupter positioned within a molded insulator.

The problem heretofore with automatic reclosers, including reclosers having molded components, is the cumbersome and complex nature of such devices.

Another component of the automatic recloser which has received attention in the electrical utility industry is the actuator utilized to operate the vacuum interrupter. U.S. Pat. No. 4,072,918—Reed, Jr., entitled Bistable Electromagnetic Actuator and UK Patent Application No. 9409139.4 filed May 9, 1994 entitled Electromagnetic Actuators, published Nov. 15, 1995 as publication no. 2,289,374 A, each disclose electromagnetic actuators for use in recloser applications. In such actuators a coil or pair of coils, in conjunction with a permanent magnet, operate to move an armature between first and second positions.

The problem with such devices generally revolves around the number of parts included in such devices. A large number of parts has the tendency to increase the complexity of assembly. Moreover, in order to establish the necessary magnetic forces for armature movement, the electric coils require a significant level of current.

Consequently, a need still exists for an automatic recloser which avoids the use of liquids and other such insulating materials and which is less cumbersome to assemble and maintain than existing reclosers. A need also exists for such reclosers to incorporate a bi-stable electromagnetic actuator which is easy to assemble and has minimized current requirements.

SUMMARY OF INVENTION

The above described problems are resolved and other advantages are achieved in an electromagnetic actuator and an automatic recloser incorporating such actuator. The actuator is shown to include a housing, a permanent magnet member, a coil, an armature, mounted to move axially within the housing between first and second positions, and a non-magnetic spacer. The armature, when in the second position, is spaced a distance from the housing by the spacer. The spacer is mounted to stop movement of the armature in the second position. In the preferred embodiment, the permanent magnet member includes a core and a number of magnet segments attached thereto. It is especially preferred for each of the permanent magnet segments to be arcuate shaped and that each segment be polarized substantially radially or in a direction parallel to the center radius of each segment. In a preferred embodiment, the housing is formed from a material having a high permeability and the spacer is formed from material having a relative permeability close to one or from a substantially non-magnetic material, such as acetal resin.

The circuit recloser is shown to include the bistable magnetic actuator, a contact switch, a connecting member, connected between the actuator the contact switch and a spring, connected to bias the connecting member in relation to the contact switch. When the actuator is in its second position the end of the connecting member is spaced from the end of the contact switch, i.e., over travel is present. An indicator is provided for indicating whether the contact switch is open or closed.

In a preferred embodiment the indicator includes first and second concentric rings, wherein the first ring is made visible to indicate closed contacts and the second ring is made visible to indicate open contacts. A manual lever is provided to mechanically engage the actuator. It is especially preferred for the recloser to include molded poles, wherein a contact closure assembly is encapsulated in each molded pole. In such an embodiment, the molded pole is formed from polyurethane.

BRIEF DESCRIPTION OF THE DRAWINGS

The present invention will be better understood, and its numerous objects and advantages will become apparent to those skilled in the art by reference to the following detailed description of the invention when taken in conjunction with the following drawings, in which.

DETAILED DESCRIPTION OF THE INVENTION

Figure 1:
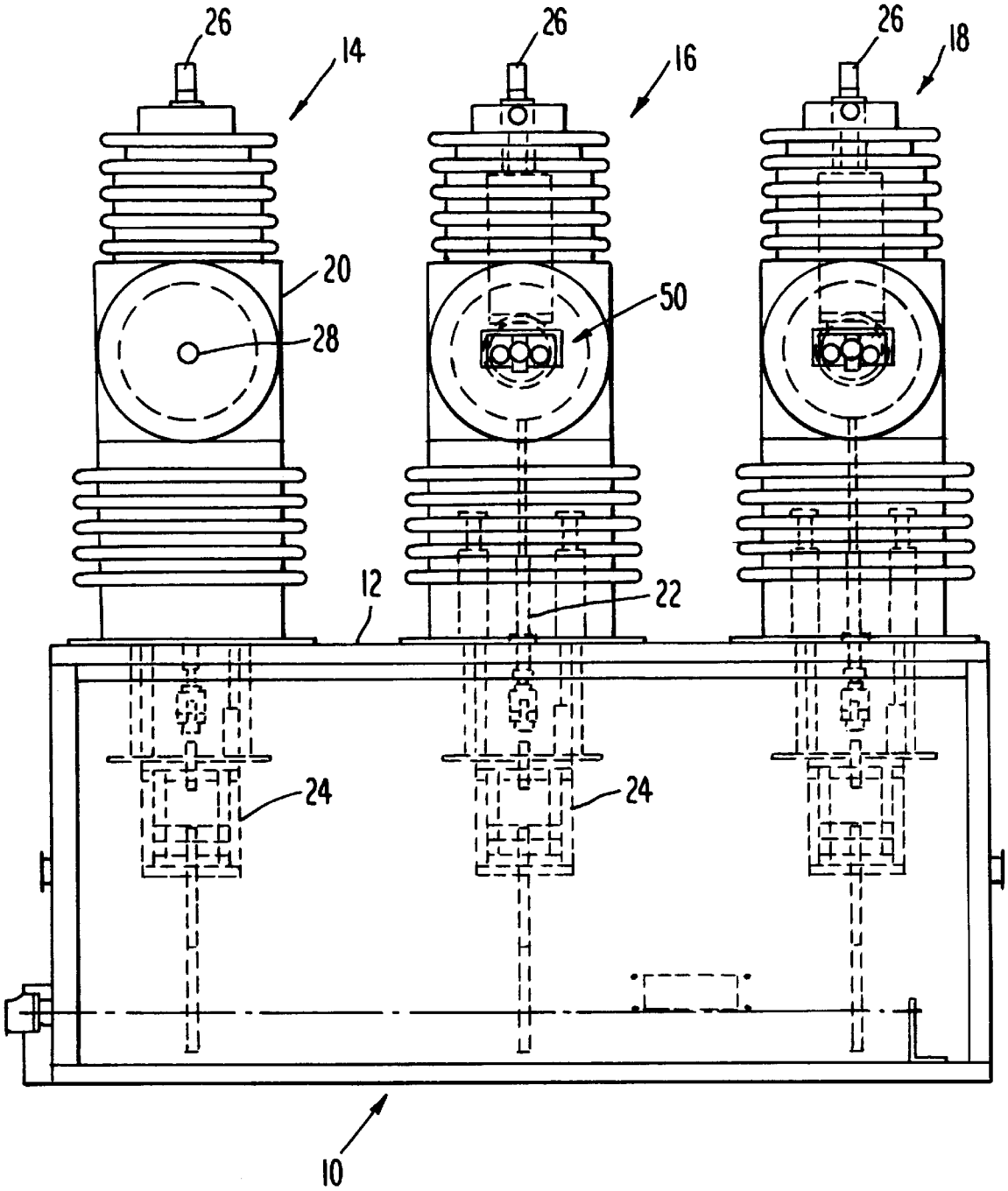
FIG. 1 is a front, partial phantom, view of a three phase automatic recloser constructed in accordance with the present invention.

Referring to the drawings wherein like numerals indicate like elements throughout, there is shown in FIG. 1 an automatic recloser 10. For purposes of describing the present invention, automatic recloser 10 is configured for three phase voltage, however, the scope of the invention is not so limited.

Recloser 10 is shown to include a housing 12 to which is attached a number of pole assemblies 14, 16 and 18. A separate pole assembly is provided for each phase. Each pole assembly generally includes three subassemblies, namely molded pole assembly 20, connecting assembly 22 and actuator assembly 24. Protruding from each pole assembly are connection studs 26 and 28. In general terms, the components of molded pole assembly 20 operate to open and close an electrical path between studs 26 and 28. The mechanical movement of the actuator assembly, as transmitted through connecting assembly 22, causes the electrical path to be opened or closed.

Figure 2:
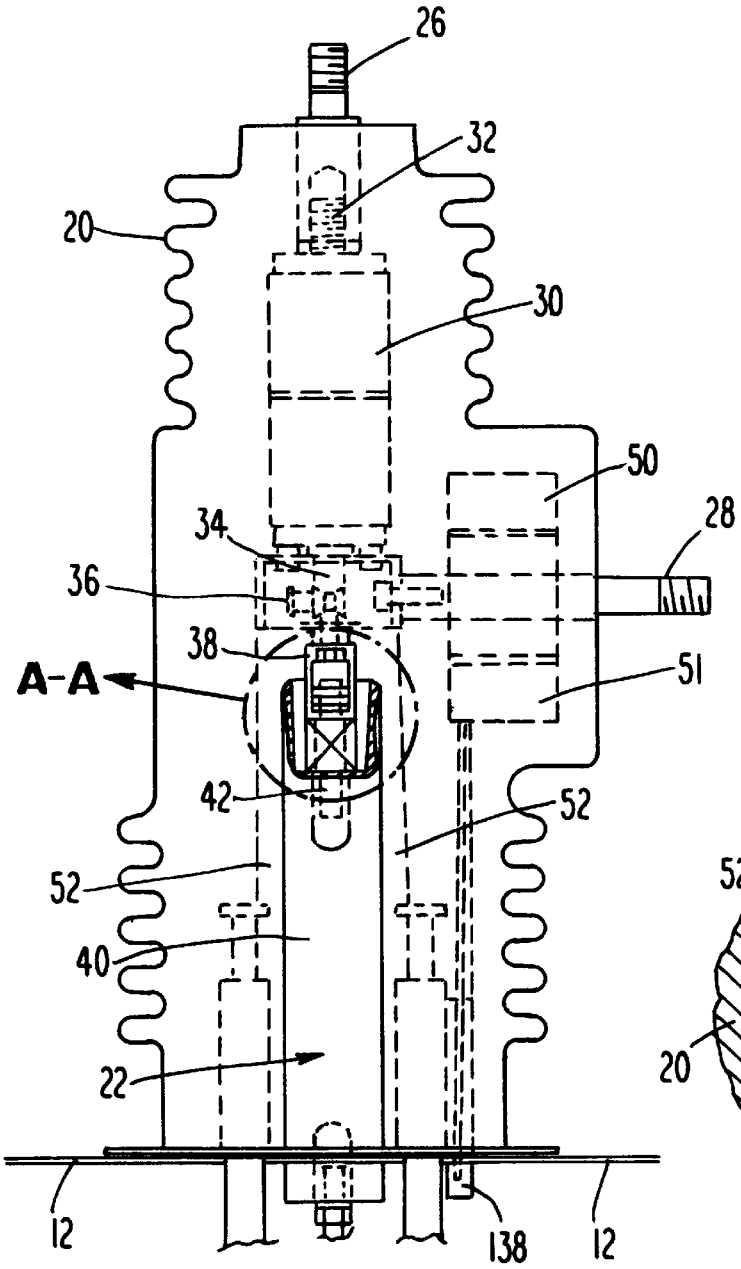
FIG. 2 is a partial section view of one of the molded poles depicted in FIG. 1.

As shown more clearly in FIG. 2, pole assembly 20 includes a vacuum interrupter 30. It is noted that interrupter 30 can be of any conventional design. It will be understood that interrupter 30 includes electrically conductive elements (not shown) which are brought into physical contact or which are separated by a distance sufficient to create an open circuit condition. Conductive elements 32 and 34 protrude from interrupter 30. Element 32 is connected to stud 26. Element 34 is electrically connected to stud 28 through the known use of roller assembly 36. In this manner, current flows through stud 26, interrupter 30 and roller assembly 36 to stud 28. The end of conductive element 34 is bolted to connecting adaptor 38.

Figure 3:
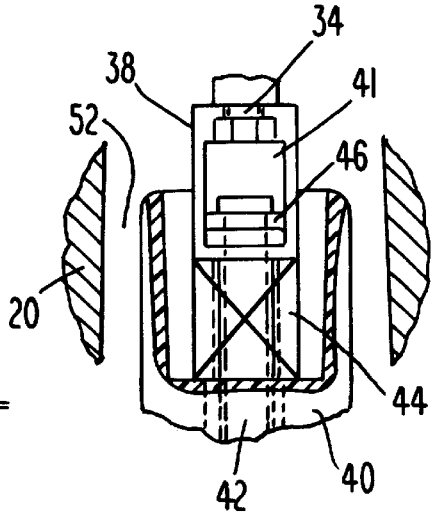
FIG. 3 is an enlarged view of the circle A—A in FIG. 2.

As shown in FIG. 3, adaptor 38 is a box-like shape having a hollow center 41 and openings formed at either end. At the top end, conductive element 34 is bolted, or otherwise securely attached, to adaptor 38. The other end of adaptor 38 slidably engages connecting assembly 22.

Assembly 22 is shown to include a non-conductive rod 40. A stud 42 is secured at one end to rod 40. The other end of stud 42 passes through the bottom opening in adaptor 38. Before stud 42 is passed through adaptor 38 a contact pressure spring 44 (shown diagrammatically) is placed over stud 42. Stud 42 is then passed into adaptor 38. The end of stud 42 is kept within adaptor 38 by the attachment of a nut 46. With this arrangement, the nut 46 is prevented from turning within the adaptor by the close fit with the sides of the adaptor and is attached to the stud 42 by turning adaptor 38 in the same manner as tightening a nut. As nut 46 is turned on stud 42, the contact pressure spring is compressed. A preset length is specified to provide the desired force. When the actuator 24 operates to close interrupter 30, assembly 30 moves freely until the conductive elements of the interrupter come together. Once in the closed position, further movement of conductive element 34 is prevented. Further movement of insulating rod 40 driven by actuator 24 slides stud 42 within adaptor 38 which compresses contact pressure spring 44. This movement also enables a gap between the lower side of nut 46 and the inside surface of adaptor 38. This distance can also be called over travel.

Vacuum interrupters require that a relatively high contact pressure be applied to the butt contacts to maintain good conductivity, prevent separation due to electromagnetic forces from momentary fault currents and welding during high current impulses. Spring 44 provide such contact pressure as well as maintaining the contact pressure even after contact erosion has taken place. FIG. 3 also shows the positioning of spring 44 in a recess 48 in non-conductive rod 40. Preferably, non-conductive rod 40 is formed from a dielectric material. The extension of the dielectric material around the assembly increases the direct electrical strike distance between energized parts and ground.

An important aspect of the invention is the placement of spring 44 at the top of rod 40. During an opening operation, spring 44 operates to accelerate rod 40 before separation of the contacts occurs in vacuum interrupter 30. The force generated by spring 44 causes the contacts within interrupter 30 to be parted by two forces, namely the opening force established by movement of actuator assembly 24 and the force resulting from the momentum of the moving rod 40. The extra rod momentum force results from the sliding engagement between stud 42 and adaptor 38. In other words, adaptor 38 and thus interrupter 30 will not directly engage until nut 46 has traveled the separation distance within adaptor 38. This extra opening force can aid in the breaking of any contact welds that might have occurred during the previous closing operation or while the contacts were in the closed position.

Poles 14, 16 and 18 can be molded from polyurethane, polymer concrete, epoxy or EPDM (ethylene propylene diene methylene), although polyurethane is preferred. During such molding or casting operation, the mechanical assembly (interrupter 30 and studs 26 and 28) is placed in a mold and held in place by securing studs 26 and 28. Any sensors such as current sensor 50 and voltage sensor 51 (FIG. 2), are held in place using porous insulating material. In the preferred embodiment the current and voltage sensors are concentric rings positioned around a portion of stud 28. In such an embodiment, the porous material is placed between the rings and stud 28. The encapsulating material, i.e., polyurethane, in its liquid state will fill all mold voids including those voids in the porous insulating material. A cavity 52 is preserved from the bottom of the current transfer system, i.e., from around bearings 36, to the bottom of the mold in order to prevent liquid encapsulating material ingress into vacuum interrupter moving parts and to leave space for adaptor 38 and rod 40. This is best achieved by placing any suitable conical structure inside the mold with one end held firmly against the current transfer system. Because of the ceramic finish provided on most commercially available vacuum interrupters, it is preferred to apply a thin layer of suitable material to facilitate bonding or adhesive between the interrupter and the encapsulating material before pouring encapsulating material into the mold.

Figure 4:
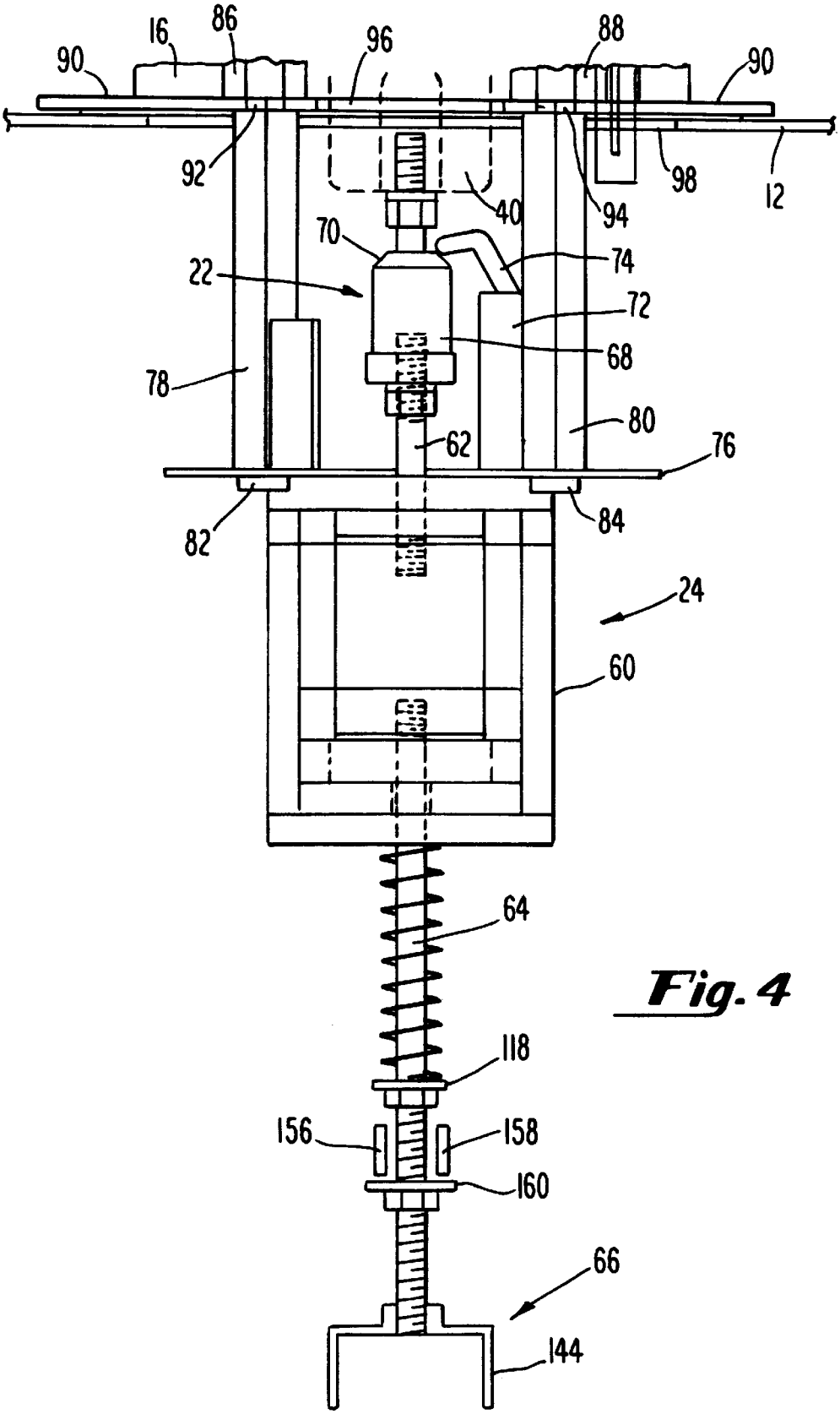
FIG. 4 is a front view of the lower portion of one of the recloser assemblies depicted in FIG. 1.

Consider now actuator assembly 24 shown in FIG. 4. Assembly 24 includes a bistable electromagnetic actuator 60, which will be described in greater detail in relation to FIG. 5. Armature rods 62 and 64 protrude from actuator 60. Rod 62 is connected to connecting assembly 22 and rod 64 extends to its connection with open/close indicator 66 (only a portion is shown in FIG. 4). As shown in FIG. 4, the end of connecting assembly 22 which attaches to rod 64 includes operating link adaptor 68. Adaptor 68 includes a frustoconical shaped camming surface 70 formed on one end. A switch 72, having a cam arm 74 are positioned so that cam arm 74 is biased against and rides along the surface of adaptor 70. As adaptor 70 moves axially, reflective of armature movement, and therefore either the opening or closing of the interrupter contacts, switch 74 will move. The movement of switch 74 generates an electrical signal representative of whether the contacts are open or closed. Such signal is provided to an electronic controller, described in greater detail in connection with FIG. 7.

Actuator 60 is attached by any suitable means to support bracket 76. Assembly 24 is mounted to molded pole 16 by the attachment of bracket 76 via spacers 78, 80 and bolts 82 and 84. In the preferred embodiment, bolts 82 and 84 mount within appropriately threaded receptacles 86, 88 encapsulated in pole 16 during the molding operation before the liquid material solidifies. A mounting plate 90 is secured between pole 16 and spacers 78, 80. In the preferred embodiment, plate 90 includes two openings 92 and 94 which correspond in number, size and position to bolts 82 and 84 so that the bolts may pass through the plate openings. Plate 90 also includes a central opening 96 sized to permit the free movement of connecting assembly 22. An opening 98 is provided in housing 12 which opening is sufficiently wide to permit the insertion of actuator assembly 24. Mounting plate 90 is dimensioned to be greater in area than opening 98. Thus, pole assembly 16 may be mounted as a unit to housing 12 by the attachment of plate 90 to housing 12 by any suitable means. In this manner, each pole assembly may be constructed separate from housing 12 and inserted or removed as a unit. This feature greatly enhances the serviceability of the pole assembly and will simplify manufacture.

Figure 5:
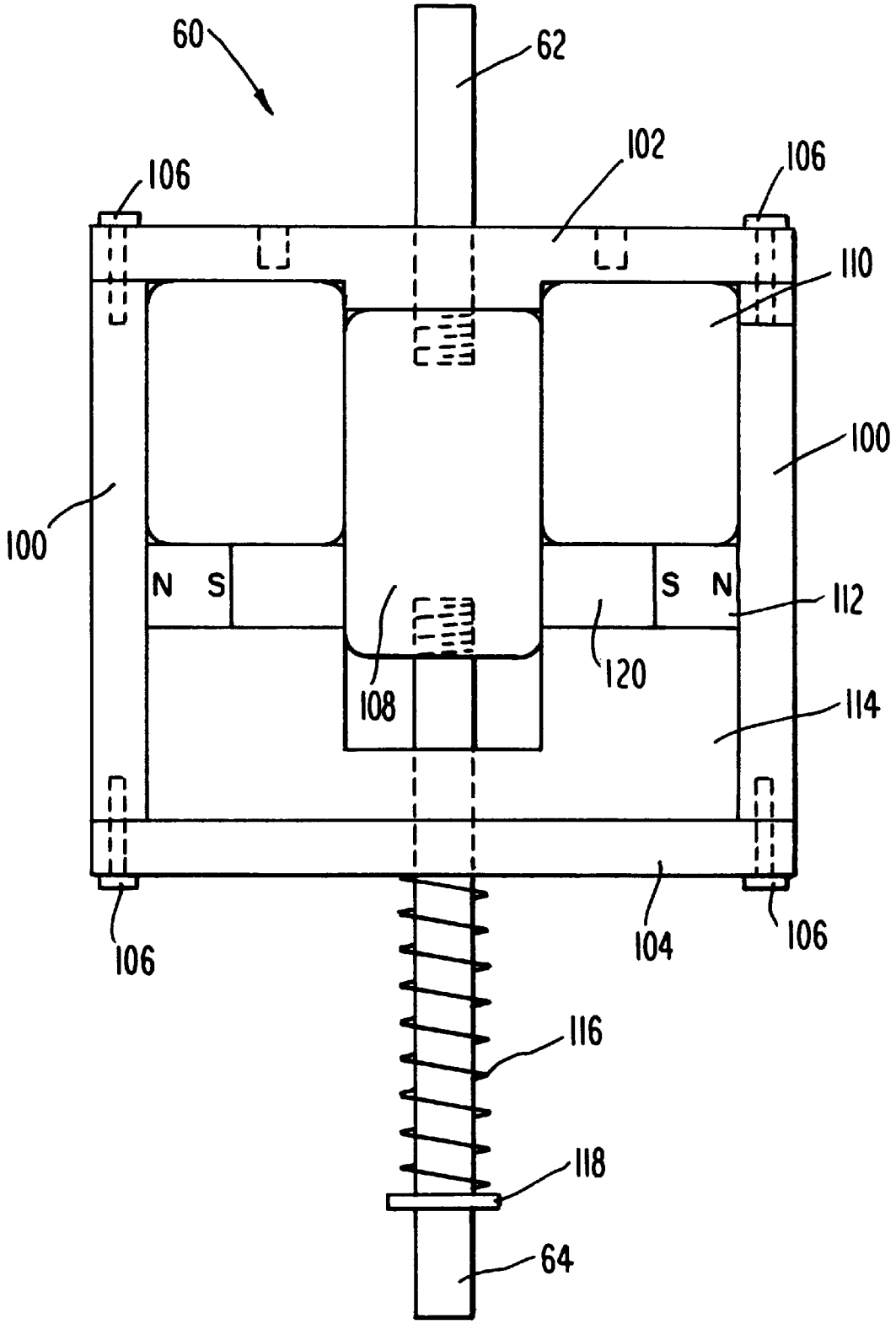
FIG. 5 is a section view of the bistable electromagnetic actuator depicted in FIG. 4.

Consider now bistable electromagnetic actuator 60 shown in FIG. 5. In the preferred embodiment, actuator 60 is cylindrically shaped and includes cylindrical body 100, top plate 102 and bottom plate 104 all of which are formed from soft iron, although any material having a sufficiently high magnetic permeability characteristic will be acceptable. Body 100 and plates 102, 104 can be connected together by any suitable means such as connecting bolts 106. It is noted that openings are formed in plates 102 and 104 sized to permit the rods 62 and 64 to pass therethrough and to permit axial movement of the rods.

Actuator 60 also is shown to include an armature 108, a coil 110, a permanent magnet 112 and a spacer 114. A compression spring 116 is mounted around rod 64 and is confined between bottom plate 104 and fixed nut or restrictor ring 118. Spring 116 biases armature 108 away from top plate 102. It is noted that while pole assembly 16 was depicted and described as in the open position, actuator 60 is depicted in FIG. 5 in the closed position, i.e., armature 108 is in a position which would cause rod 62, and thus connecting assembly 22, to close the contacts within interrupter 30.

In the preferred embodiment, magnet 112 is cylindrically shaped and includes a soft iron core 120. Magnet 112 is preferably formed from high energy density anisotropic sintered Neodymium Iron Boron (NeFeB). The physical features of magnet 112 will be described in relation to FIG. 6.

In operation, armature 108 is held in the closed position (the position depicted in FIG. 5) by the magnetic field established radially from magnet 112 through cylindrical body 100, radially through top wall or plate 102, into armature 108 and back to magnet 112 through iron core 120. While in this position, spring 116 is held in its maximum state of compression and contains the energy necessary to "open" actuator 60. As previously described, when armature 108 is in this position, rod 62 via connecting assembly 22 compresses spring 44 (FIG. 3) to provide the necessary holding forces on the interrupter contacts. The force exerted on armature 108 by the compressed spring 44 is in a direction which opposes the armature position shown in FIG. 5. The holding forces necessary to hold armature 108 in this closed position are selected to overcome both the opening force of spring 116 and the opening force of spring 44.

In the open position, the bottom surface of armature 108 will rest against spacer 114. In the preferred embodiment, spacer 114 is formed from non-magnetic material having a relative permeability close to 1. When in this position, armature 108 is held by the compression force of spring 116, which compression force can be adjusted by adjusting the fixed nut 118. A small amount of holding force is also generated by the radially established magnetic field through non-magnetic spacer 114, to armature 108 and back to magnet 112 through core 120. The magnetic force generated in this path is reduced due to the presence of non-magnetic spacer 114. Spacer 114 reduces the effective permeability of the magnetic circuit, thereby adjusting the operating point of the permanent magnet.

Actuator 60 is moved from the open position to the closed position (shown in FIG. 5) and visa versa, by providing short duration electrical pulses to coil 110. Current flowing in coil 110 establishes a magnetic field oriented through the central opening of the coil. Armature 108 is moved to the closed position by providing a short duration electrical current pulse to coil 110 which establishes a magnetic field coinciding with the orientation of the magnetic field established by permanent magnet 112. The net flux established in the air gap between armature 108 and top plate 102 creates an attractive force which seeks to minimize the gap. This force is sufficient to overcome the compression force exerted by spring 116 and spring 44. In the closed position, permanent magnet 112 sees a high permeability path in the top magnetic circuit (CORE 120, armature 108, top plate 102 and side wall 106), which adjusts the permanent magnet operating point to create a flux through top plate 102 and armature 108. This flux provide the necessary holding force when the closing electrical pulse is removed from coil 110.

Armature 108 is moved to the open position by providing a short duration electrical pulse to coil 110 which establishes a magnetic field orientation around the coil which opposes the magnetic orientation of the field established by permanent magnet 112. The resulting reduction in net flux reduces the magnetic latch established by the permanent magnet field between plate 102 and armature 108 and allows the biasing forces exerted by spring 118 and spring 44 to move armature 108 to the open position. In the preferred embodiment, spacer 114 is formed from aluminum or acetal resin such as DELRIN®. The position of armature 108 in the closed or open position constitutes the two stable states of actuator 60.

Figure 6:
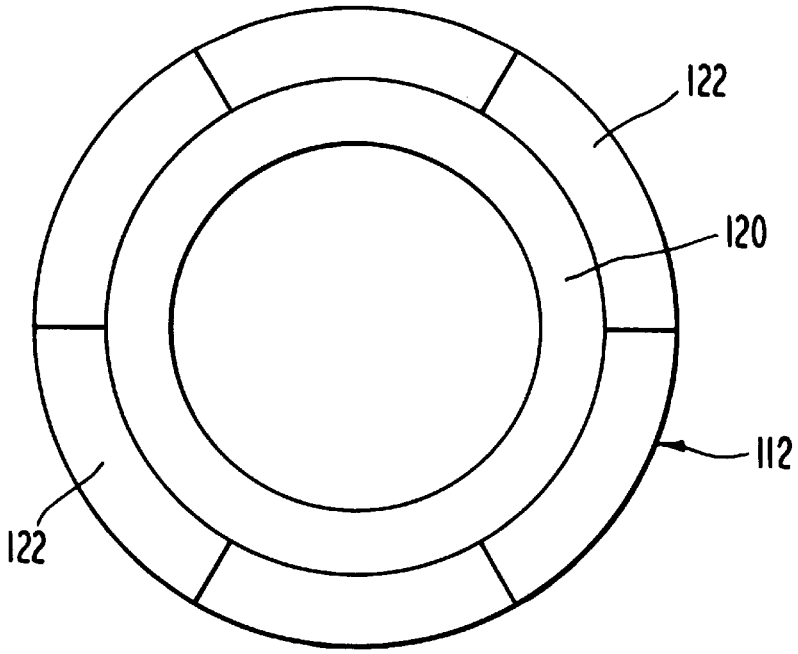
FIG. 6 is an isolated plan view of the permanent magnet depicted in FIG. 5.

Referring now to FIG. 6, permanent magnet 112 is depicted in greater detail. Particularly, a number of magnet arc segments 122 are bonded onto the outside diameter of soft iron ring 120. Due to the brittle nature of many permanent magnet materials, including NeFeB, the use of ring 120 protects the magnetic material from frictional damage or impact damage from the moving armature 108. In the preferred embodiment, segments 122 are radially magnetized from the inside diameter of the arc segment to the outside diameter. The creation of such a magnetized segment is not easily accomplished. A radially oriented magnetic field which is substantially similar in effect can be produced by magnetizing each segment along a single direction. To this end, each arc segment 122 is magnetized in a direction parallel to the center radius of the segment. Although the magnetic field is not truly radial, the assembly of multiple segments around an iron core results in a magnetic field which is substantially radial.

It will be appreciated from the above description of actuator 60 that the number of components required have been reduced to a minimum. Moreover, due to the efficiency of the permanent magnetic assembly, the permanent magnet volume within the actuator has been minimized. By minimizing magnet volume, a larger volume is available in a given actuator design to place a more effective coil, i.e., greater ampere-turn capability at a given supply voltage.

In addition, use of non-magnetic spacer 114 together with a pre-load on spring 116 provides a retaining force in the open position which is not excessive. In other words, the energy necessary to move armature 108 to the closed position is minimized. Spacer 114 serves to weaken the attracting force of armature 108 to bottom plate 104 by interposing a non-magnetic path in the magnetic circuit. This reduces the energy required for a closing operation.

Figure 7:
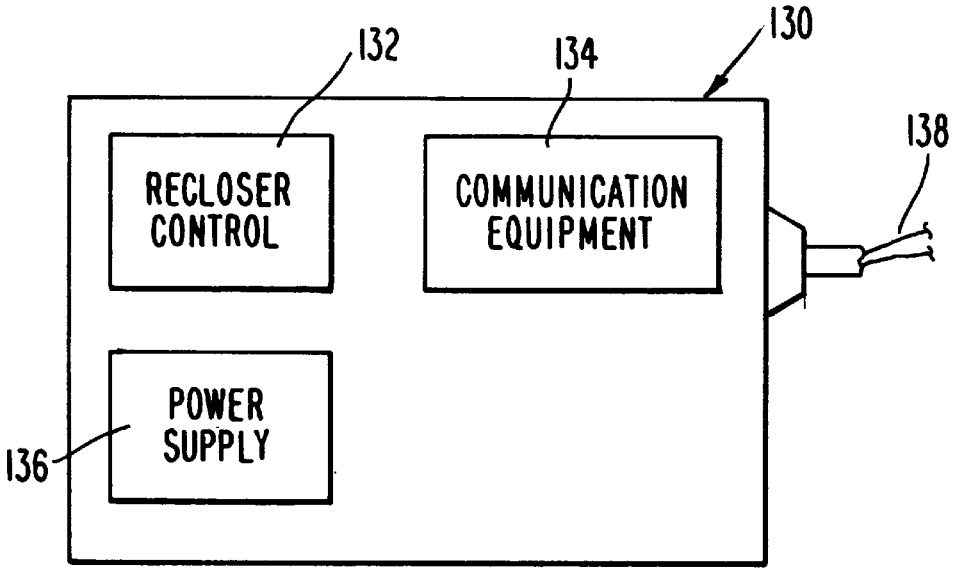
FIG. 7 is a diagrammatic view of the control system used to control the recloser depicted in FIG. 1.

Referring now to FIG. 7, there is shown a controller 130. Controller 130 generates the electrical signals necessary to energize coil 110 to move armature 108 to either the open or closed position. To this end, controller 130 includes recloser control circuit 132. Since no particular form of circuit configuration is preferred, no further description is made of this circuit. Although no particular circuit description is given, it is noted that each pole assembly includes a separate and independent magnetic actuator 24. It is within the scope of the invention for controller 130 to generate either a single control signal which will act on all actuators or controller 130 can generate independent control signals so that each actuators can be controlled separately from the other actuators. In that embodiment, it would be possible to open or close the interrupters one at a time. Controller 130 also includes communication circuit 134 and power supply 136. It is noted that recloser control circuit 132 receives signals from current sensor 50 and voltage sensor 51 via conductors 138 and transmits appropriate electrical pulses to coil 110.

Figures 8, 9:
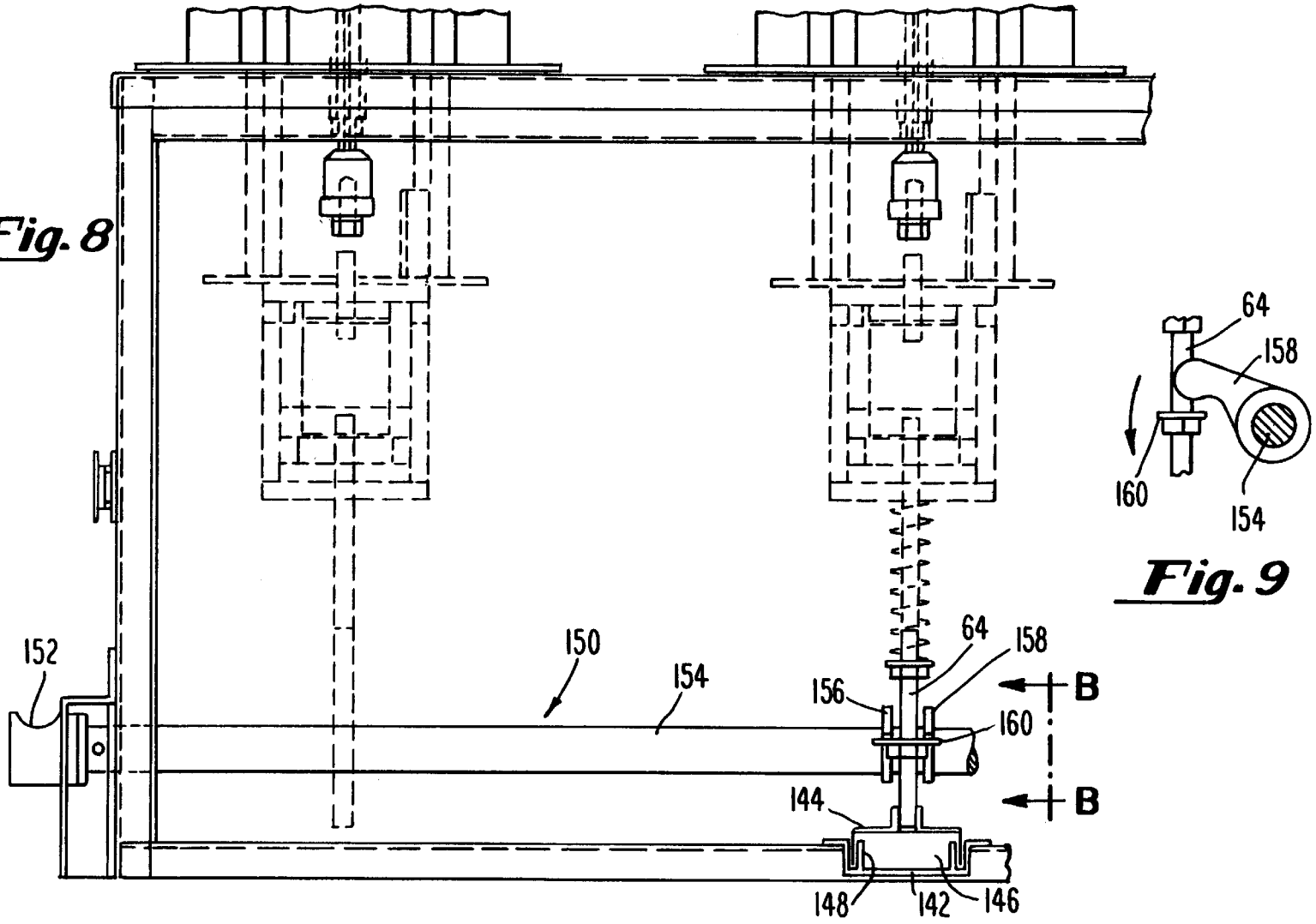
FIG. 8 is a front view of a portion of the recloser assembly depicted in FIG. 1.
FIG. 9 is a section view along the line B—B in FIG. 8.

Referring now to FIG. 8, the means for indicating whether pole assembly 16 is in the open or closed condition is depicted. In particular, a pair of cup-shaped members 142 and 144 are shown. Member 142 is attached by any suitable means to housing 12. An opening is provided in the bottom of housing 12 through which cup member 142 extends. Member 142 defines an interior cavity 146. Ring 148 is formed in cavity 146. A groove is now defined between ring 148 and the side walls of cup member 142. In the preferred embodiment, the side walls of cup member 142 are formed from a transparent or translucent material and ring 148 is colored. Accordingly, one viewing member 146 would see the color of ring portion of member 142. Member 144 is oriented and sized so that its side walls can be inserted into the groove between ring 148 and the side walls of member 142. Member 144 is shown isolated in FIG. 4. Member 144 is colored a different color than ring 148. In operation, when pole assembly 16 is closed, member 144 will be withdrawn into housing 12 from the groove formed in member 142 thereby permitting the color of ring 142 to be viewed. When pole assembly 16 is in the open position, as shown in FIG. 8, the side walls of member 144 are inserted into the groove formed in member 142 thereby blocking a view of ring 148 and instead presenting the color of member 144. In this way, a determination can be made of whether pole assembly 16 is open or closed by merely noting the color of the indicator at the bottom of housing 12.

It will be appreciated that in certain circumstances it is necessary to manually open or close pole assembly 16. To that end, manual mechanism 150 is provided. Mechanism 150 includes lever or operating handle 152 mounted to shaft 154. Shaft 154 passes through housing 12 and is rotatably attached thereby. Arms 156 and 158 are securely attached to shaft 154 and positioned on either side of rod 64. A stop 160 is securely attached to rod 64. When it is desired to open pole assembly 16, lever 152 is rotated thereby rotating shaft 154. The rotation of shaft 154 moves arms 156 and 158 against stop 160 forcing rod 64 to move axially downward. This axial movement causes the interrupter contacts to open at normal operating speed, since once contact separation is achieved the opening spring 116 will complete the operation. It would be possible to close the interrupter this way, however, the contact closing speed would be directly tied to the operating speed of the manual operating handle 152. Presumably, such speed would be below the recommended operating speed.

Figure 10:
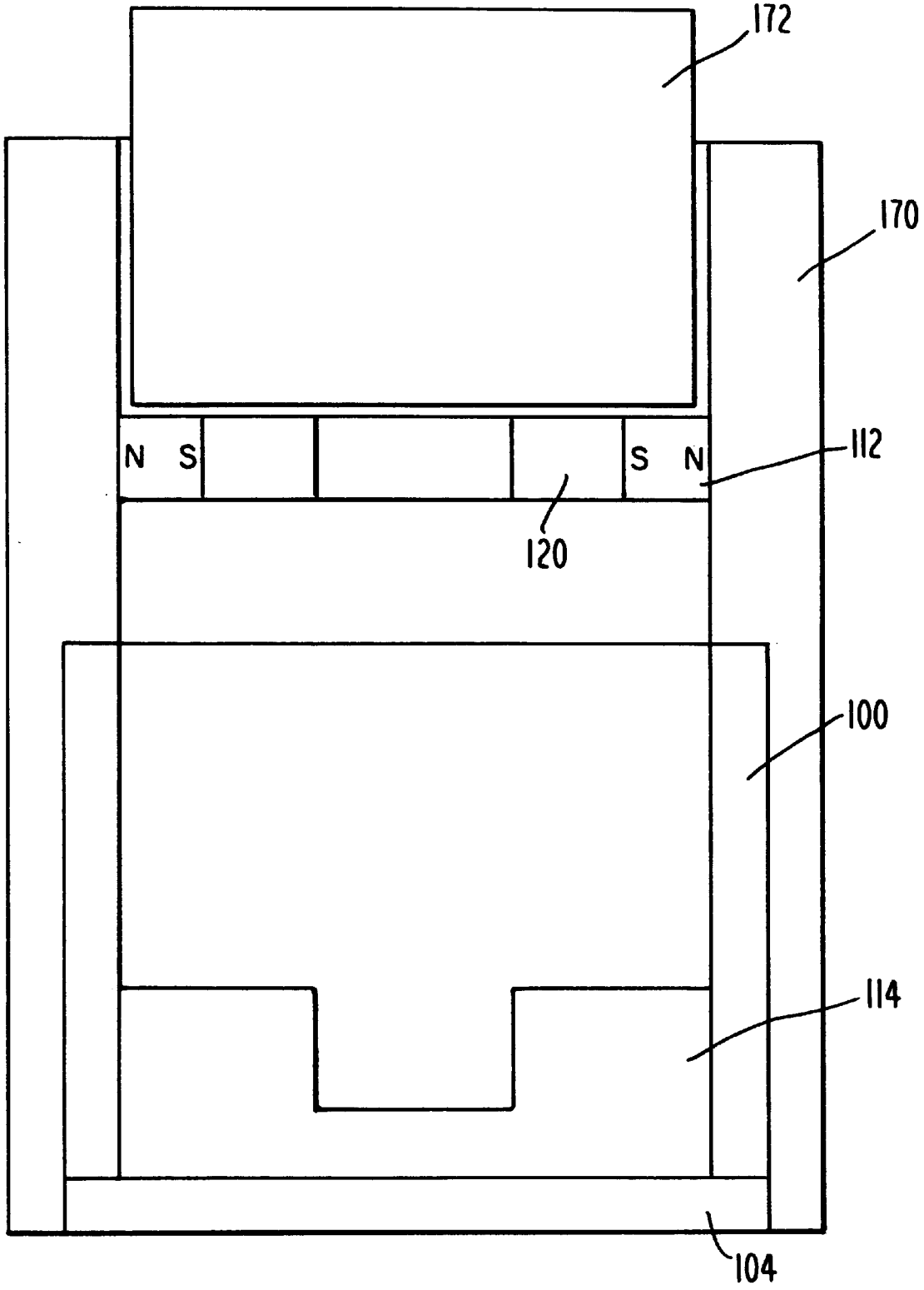
FIG. 10 is a sectional view of an assembly device used to position the permanent magnet depicted in FIG. 6 into the actuator of FIG. 1.

Referring now to FIG. 10, a fixture is disclosed for installing permanent magnet 112 and core 120 into body 100. To this end, a non-magnetic cylinder 170 is disclosed. Cylinder 170 fits over and around body 100. The inside diameter of fixture 170 is designed to match the inside diameter of cylindrical body 100. To install the permanent magnet, the installation fixture is fixed over body 100. Spacer 114 may be inserted at this point or it may have already been inserted into body 100. Permanent magnet 112 and core 120 are inserted into the top of installation fixture 170. Since the installation fixture is formed from non-magnetic material, there is no tendency for the magnet to become attracted to high permeability materials. A non-magnetic cylindrical plunger 172 is used to push magnet 112 through installation fixture 170 and into body 100. It is preferred to fix the position of permanent magnet 112 within body 100 by the formation of a ridge at an appropriate location on the inside wall of body 100.

Figure 11:
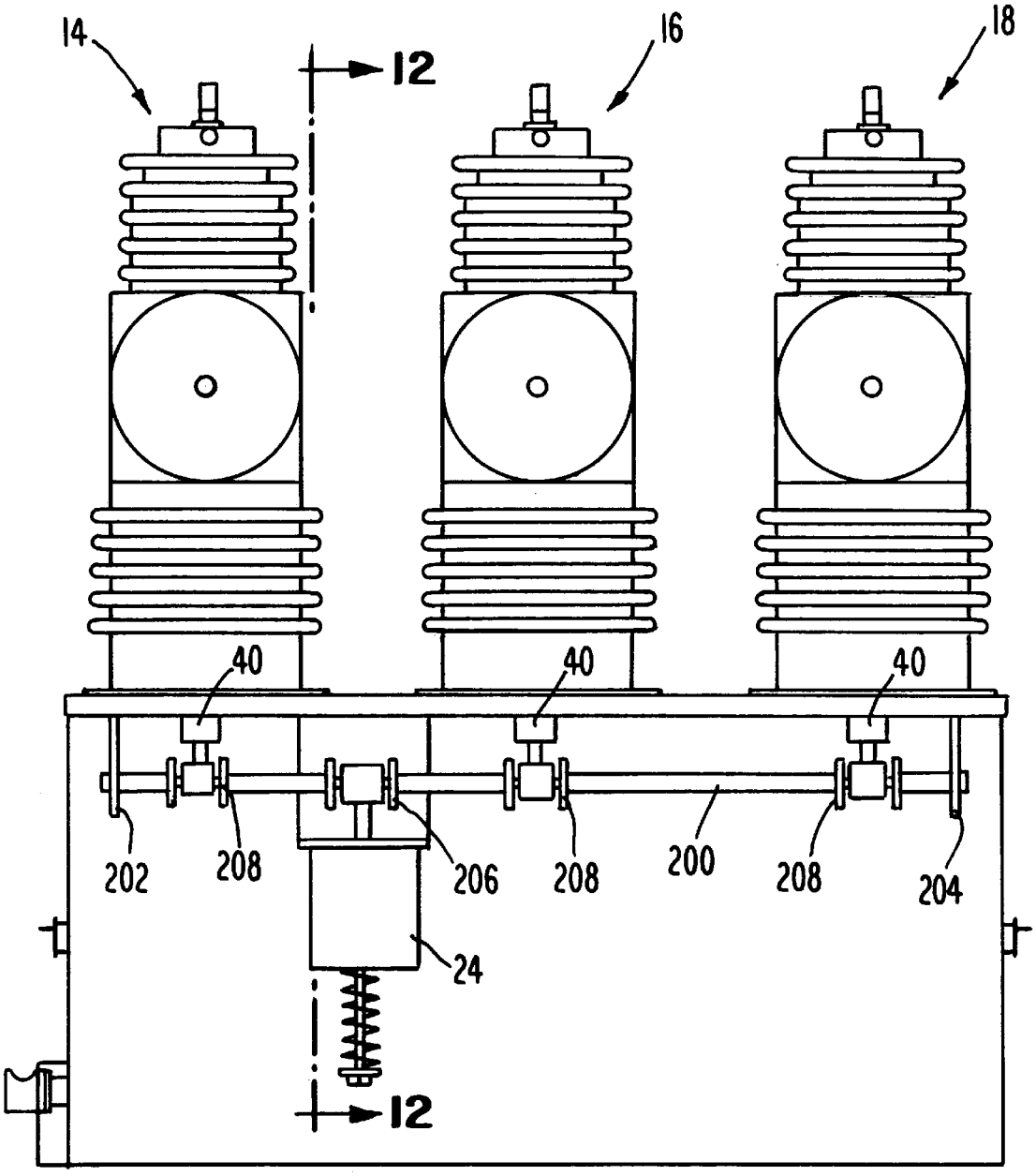
FIG. 11 is a front, partial section, view of a three phase automatic recloser constructed in accordance with an alternate embodiment of the present invention.
Figure 12:
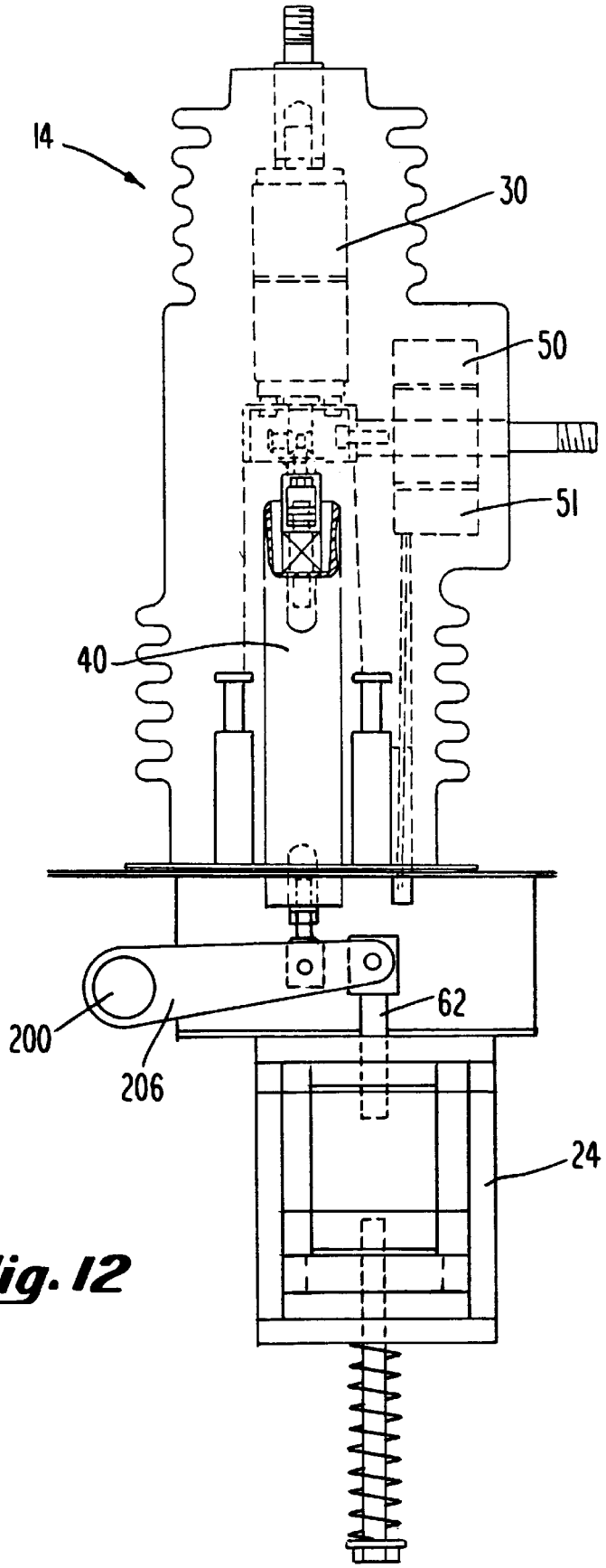
FIG. 12 is a sectional view along the line 12—12 in FIG. 11.

Referring now to FIGS. 11 and 12, wherein like reference numerals designate corresponding structure throughout the views, an alternative embodiment of the invention will be described. In this embodiment, a single magnetic actuator 24 is used to open and close the contacts within each interrupter 30 contained within each molded pole assemblies 14, 16 and 18.

As shown in FIG. 11, linkage arm 200 is pivotally attached to housing 12 by brackets 202 and 204. Lever arm 206 (shown more clearly in FIG. 12) is fixed at one end to linkage arm 200 and pivotally connected at its other end to actuator rod 62. Movement of actuator rod 62 will result in the pivotal movement of lever 206, which in turn causes linkage arm 200 to rotate. Although connection between lever arm 206 and actuator rod 62 can be any suitable means, allowance will have to be made for the relative movement which will occur between the axially moving rod 62 and pivoting lever 206. For example, rod 62 could be jointed or the connection between lever 206 and rod 62 could be designed to allow for any relative movement.

Each connecting rod 40 is also attached to linkage arm 200 by lever arm 208. Similar to lever 206, lever 208 is fixed at one end to linkage arm 200 and pivotally connected at its other end to connecting rod 40. Again, although the connection between lever arm 208 and connecting rod 40 can be any suitable means, allowance will have to be made for the relative movement which will occur between the axially moving rod 40 and pivoting lever 208.

While the invention has been described and illustrated with reference to specific embodiments, those skilled in the art will recognize that modification and variations may be made without departing from the principles of the invention as described herein above and set forth in the following claims.

What is claimed is:

1. An electromagnetic actuator, comprising:

a housing;

a permanent magnet member, mounted in said housing;

a coil, mounted in said housing, said coil and said permanent magnet defining a cavity within said housing;

an armature, mounted in said housing, wherein said armature moves axially within said cavity between first and second positions;

a non-magnetic spacer, mounted within said housing at one end of said cavity, whereby said armature when in said second position is spaced by said spacer a distance from the end of said housing adjacent said spacer; and a spring, mechanically connected to said armature, for biasing said armature towards said second position.

2. The actuator of claim 1, wherein said spacer is mounted to stop the movement of said armature in said second position.

3. The actuator of claim 1, wherein said permanent magnet member comprises a core and a number of magnet segments attached thereto.

4. The actuator of claim 3, wherein said cavity is generally cylindrical and wherein each of said permanent magnet segments comprises an arcuate shaped.

5. The actuator of claim 4, wherein said segments are polarized substantially radially in relation to said cavity.

6. The actuator of claim 5, wherein each of said segments has a center radius and wherein the polarization of each of said segments is in a direction parallel to the center radius of said segment.

7. The actuator of claim 1, wherein said permanent magnet is formed from an anisotropic material.

8. The actuator of claim 7, wherein said anisotropic material comprises Neodymium Iron Boron.

9. The actuator of claim 1, wherein said housing is formed from a material having a high permeability and wherein said spacer is formed from material having a relative permeability close to one.

10. The actuator of claim 1, wherein said spacer is formed from a substantially non-magnetic material.

11. The actuator of claim 9, wherein said spacer is formed from acetal resin.

12. The actuator of claim 1, further comprising a second biasing spring.

13. A circuit recloser, comprising:

a bistable magnetic actuator, adapted for moving an actuating rod between first and second positions;

a contact switch, said contact switch having an end;

a connecting member, connected between said actuator rod and said contact switch, said connecting member connected to slidably engage said contact switch, wherein when said actuator rod is in said second position the end of said connecting member is spaced from the end of said contact switch; and a spring, connected to bias said connecting member in relation to said contact switch.

14. The reclosers of claim 13, further comprising an indicator for indicating whether said contact switch is open or closed.

15. The reclosers of claim 14, wherein said indicator comprises first and second concentric rings, wherein said first ring is made visible to indicate closed contacts and said second ring is made visible to indicate open contacts.

16. The reclosers of claim 15, further comprising a housing in which said actuator is mounted, wherein said first ring is connected to said actuator and said second ring is connected to said housing.

17. The reclosers of claim 13, further comprising a manual lever, connected to mechanically engage said actuator for moving said actuator, thereby moving said contact switch.

18. The recloser of claim 13, further comprising a molded pole, wherein said contact switch is encapsulated in said molded pole.

19. The reclosers of claim 18, wherein said molded pole comprises polyurethane.

20. The reclosers of claim 13, wherein said contact switch comprises a vacuum contact closure assembly.

21. The reclosers of claim 20, wherein said contact closure assembly comprises a housing and further comprising a layer of bonding material applied to said housing.

22. A reclosers assembly, comprising:

a bistable magnetic actuator;

a contact closure assembly;

a molded pole, wherein said contact closure assembly is encapsulated in said molded pole, and wherein said actuator is attached to said molded pole;

a connecting member for connecting said actuator to said closure assembly, wherein movement of said connecting member slidably engages said contact closure assembly;

a spring, connected to bias said connecting member away from said contact closure assembly; and a fastening plate, attached to said molded pole, for attachment of said molded pole.

23. A reclosers assembly, comprising:

a bistable magnetic actuator;

a plurality of contact closure assemblies;

a plurality of molded poles, wherein each of said contact closure assemblies is encapsulated in a molded pole; and a connecting member for connecting said actuator to each of said closure assemblies, wherein movement of said connecting member engages said contact closure assemblies.

* * * * *